US005571054A

United States Patent [19]

Chantal

[11] Patent Number: 5,571,054

[45] Date of Patent: Nov. 5, 1996

[54] SYNTHETIC GOLFING TEE AND METHOD OF MANUFACTURING SAME

[76] Inventor: Mark A. Chantal, P.O. Box 754, Goffstown, N.H. 03045

[21] Appl. No.: 456,958

[22] Filed: Jun. 1, 1995

[51] Int. Cl.[6] ..... A63B 57/00

[52] U.S. Cl. ..... 473/387; 273/DIG. 24

[58] Field of Search ..... 273/33, 202–212, 273/DIG. 24, 32 D; 473/387

[56] References Cited

U.S. PATENT DOCUMENTS

| | | | |
|---|---|---|---|
| 1,522,544 | 1/1925 | Pryde | 273/33 |
| 2,011,203 | 8/1935 | Seiki | 273/33 |
| 4,479,649 | 10/1984 | Newcomb et al. | 273/DIG. 24 |
| 4,948,130 | 8/1990 | Rydborn | 273/33 |
| 5,154,417 | 10/1992 | Kohli | 273/33 |

FOREIGN PATENT DOCUMENTS

| | | | |
|---|---|---|---|
| 525115 | 8/1940 | United Kingdom | 273/212 |
| 2261824 | 6/1993 | United Kingdom | 273/32 D |
| 4009866 | 5/1994 | WIPO | 273/33 |

*Primary Examiner*—Steven Wong
*Attorney, Agent, or Firm*—Davis and Bujold

[57] ABSTRACT

An improved synthetic golf tee which has a substantially uniform transverse cross sectional wall thickness along the entire length thereof from a ball supporting end to a tapered end. The tee can be manufactured by either injection molding or machining and is the same weight or is slightly heavier in weight than a conventional wooden tee. A central bore extends through a major portion of the golf tee.

20 Claims, 2 Drawing Sheets

SYNTHETIC GOLFING TEE AND METHOD OF MANUFACTURING SAME

FIELD OF THE INVENTION

This invention relates to an improvement concerning non-wooden (synthetic) golf tees and a process for manufacturing the same.

BACKGROUND OF THE INVENTION

The most prevalent golf tee manufactured today is a wooden tee which is relatively inexpensive to manufacture but readily breaks or fractures when struck by a golf club during a golf swing. Accordingly, the tee area of a golf course or practice area is generally littered with wooden golf tees which are unsightly and also cause mowing problems, e.g. wooden golf tees tend to dull the blades of the lawn mower.

SUMMARY OF THE INVENTION

Wherefore, it is an object of the present invention to overcome the aforementioned problems and drawbacks associated with the prior art golf tee designs.

Another object of the invention is to provide a light weight and durable golf tee which is relatively inexpensive to manufacture and resists breakage.

A still further object of the invention is to provide a tee which is the same weight or slightly heavier than conventional wooden tees and has a substantially uniform transverse cross-sectional wall thickness along its entire length.

Yet another object of the invention is to provide a golf tee which is sufficiently light so that the golf tee has less of a tendency to be hit or batted down the fairway by the golf club and thus remains closer to the golfer once the golf swing is completed, to facilitate easy retrieval of the golf tee.

One other object of the invention is to provide a golf tee which has a less adverse effect on the environment. Using a synthetic material will reduce the amount of wood used to manufacture golf tees and, in turn, will reduce the number of trees cut down.

The invention relates to a synthetic golf tee comprising a ball supporting end having an annular surface which is contoured for supporting a golf ball; a tapered end for facilitating insertion of at least a portion of the synthetic tee into a ground surface; and an intermediate portion interconnecting said ball support and said tapered end with one another to form a contiguous golf tee; wherein a central bore extends completely through said ball supporting end and said intermediate portion.

The invention also relates to a method of manufacturing a synthetic golf tee comprising the steps of providing a ball supporting end with an annular surface which is contoured for supporting a golf ball; providing said synthetic golf tee with a tapered end for facilitating insertion of at least a portion of the synthetic tee into a ground surface; providing an intermediate portion to interconnect said ball support and said tapered end with one another to form a contiguous golf tee; and forming a central bore completely through said ball supporting end and said intermediate portion.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
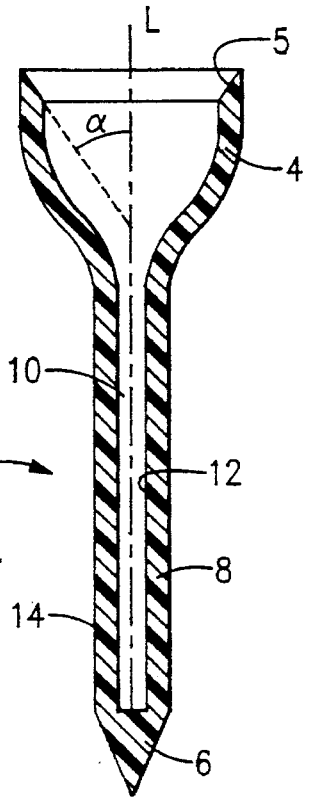
FIG. 1 is a diagrammatic front elevational cross-sectional view of the synthetic golf tee according to the present invention.
Figure 2:
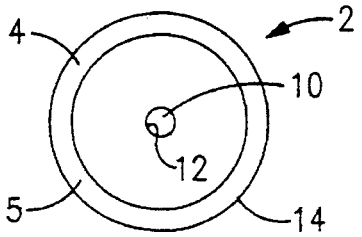
FIG. 2 is a diagrammatic top plan view the synthetic golf tee of FIG. 1.

Turning now to FIGS. 1 and 2, a detailed description concerning the present invention will now be provided. As can be seen in those figures, the synthetic golf tee 2 comprises a ball supporting end 4 interconnected with a tapered end 6 via an intermediate portion 8. The synthetic tee 2 has a central cylindrical bore 10 extending completely through the ball supporting end 4 and substantially through the entire length of the intermediate portion 8. By this arrangement, the synthetic golf tee 2 is provided with an interior surface 12 and an exterior surface 14. The exterior shape of the synthetic tee 2 is substantially a mirror image of the shape of a conventional golf tee.

The synthetic tee 2 defines a longitudinal axis L as can be seen in FIG. 1. The ball supporting end 4 has an annular ball support surface 5 which forms an angle $\alpha$ with a longitudinal axis L of the golf tee 2. This angle $\alpha$ would be on the order of 30° to 85°, and may be preferably about 80°.

Both the interior surface 12 and the exterior surface 14 of the synthetic golf tee 2 are contoured so that the wall thickness of the tee of the ball supporting end 4 and of the intermediate portion 8 has a substantially uniform transverse cross sectional thickness along the entire length of those two components.

It is anticipated that the wall thickness of those two components would be on the order of between about 1.34 mm–2.29 mm (0.053 inches–0.090 inches), and preferably about 1.57 mm (0.62 inches). The tee would have an overall length of approximately 53.98 mm (2.125 inches) and the ball supporting end 4 would have a diameter of approximately 12.47 mm (0.490 inches) while the intermediate portion 8 would have a diameter of approximately 5.59 mm (0.220 inches). The central bore 10 would have a diameter on the order of between approximately 1.27 mm–2.36 mm (0.050 inches–0.093 inches).

The ball supporting end typically has a length of 19.05 mm (0.750 inches), the intermediate portion 8 has a length of 30.15 mm (1.187 inches) and the tapered end 6 has a length of 4.75 mm (0.187 inches).

Preferably the golf tee 2 is manufactured from synthetic material, e.g. a thermoplastic polymer or acetal resin. A few suitable materials are sold by I.E. DuPont de Nemours & Company, Inc. under the trademarks DELRIN® and DELRIN AF®. Such materials result in a golf tee which has a slick exterior surface and are sufficiently durable and flexible to accomplish the objectives of the present invention.

Figure 3:
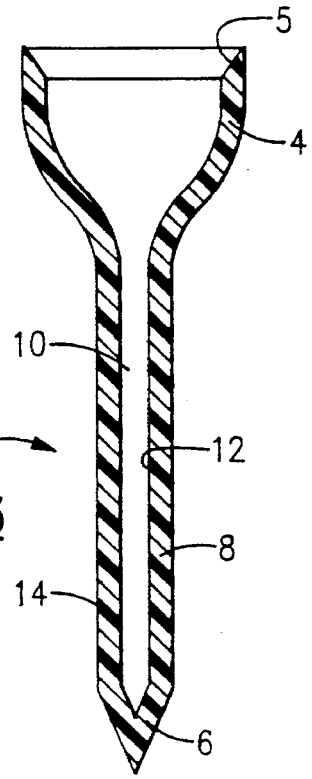
FIG. 3 is a diagrammatic front elevational cross-sectional view of a second embodiment of the synthetic golf tee according to the present invention.

Turning now to FIG. 3, a second embodiment of the present invention will be discussed. This embodiment is substantially identical to the first embodiment except that the substantially constant cross sectional wall thickness extends completely through the intermediate portion 8 to the tapered end 6 so that the entire length of the synthetic tee 2 has a substantially constant transverse cross sectional wall thickness.

Figure 4:
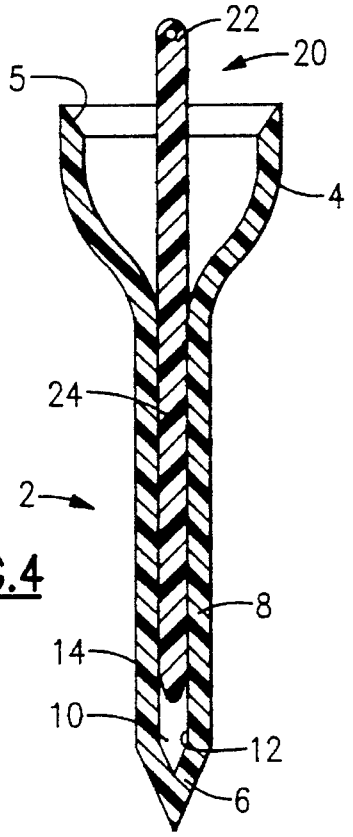
FIG. 4 is a diagrammatic front elevational cross-sectional view showing the engagement between the synthetic golf tee and a carrying device according to the present invention.

With reference to FIG. 4, an elongate tee carrying device 20 to be used in combination with the synthetic tee 2 will now be discussed in detail. The tee carrying device 20 has a head section 22, a cylindrical body section 24, and a tail section 26. The head section 22 is provided with an attachment mechanism which could be, for example, an eye hook secured to the head section 22, a hole drilled through the head section 22, or some other similar mechanism attached to or formed as part of the head section 22 for allowing the tee carrying device 20 to be conveniently carried by a golfer via an intermediate member, e.g. a string, chain, wire, etc.

The body section 24 is cylindrical in shape and has a diameter which is slightly larger, e.g. larger by a few millimeters or so, than the inner diameter of the central bore 10 so that when the body section 24 is received within the central bore 10, an interference fit is achieved between those components and the synthetic tee 2 is releasably supported by the tee carrying device 20. The tail section 26 is preferably contoured or tapered so as to facilitate insertion or engagement of the tee carrying device 20 within the synthetic tee 2.

Preferrably the body section 24 would have an exterior diameter of approximately 1.35–2.36 mm (0.053–0.093 inches). Due to the interference fit between the body section 24 and the central bore 10, the golf tee 2 is releasably secured to the tee carrying device 20 and, when desired, can be readily removed therefrom simply by sliding the synthetic tee 2 axially relative to the tee carrying device 20 until the body section 24 becomes disengaged from the central bore 10. Thereafter, the synthetic tee 2 is ready for use and, after use, the synthetic tee 2 is again attached to the tee carrying device 20 for convenient transport.

Figure 5:
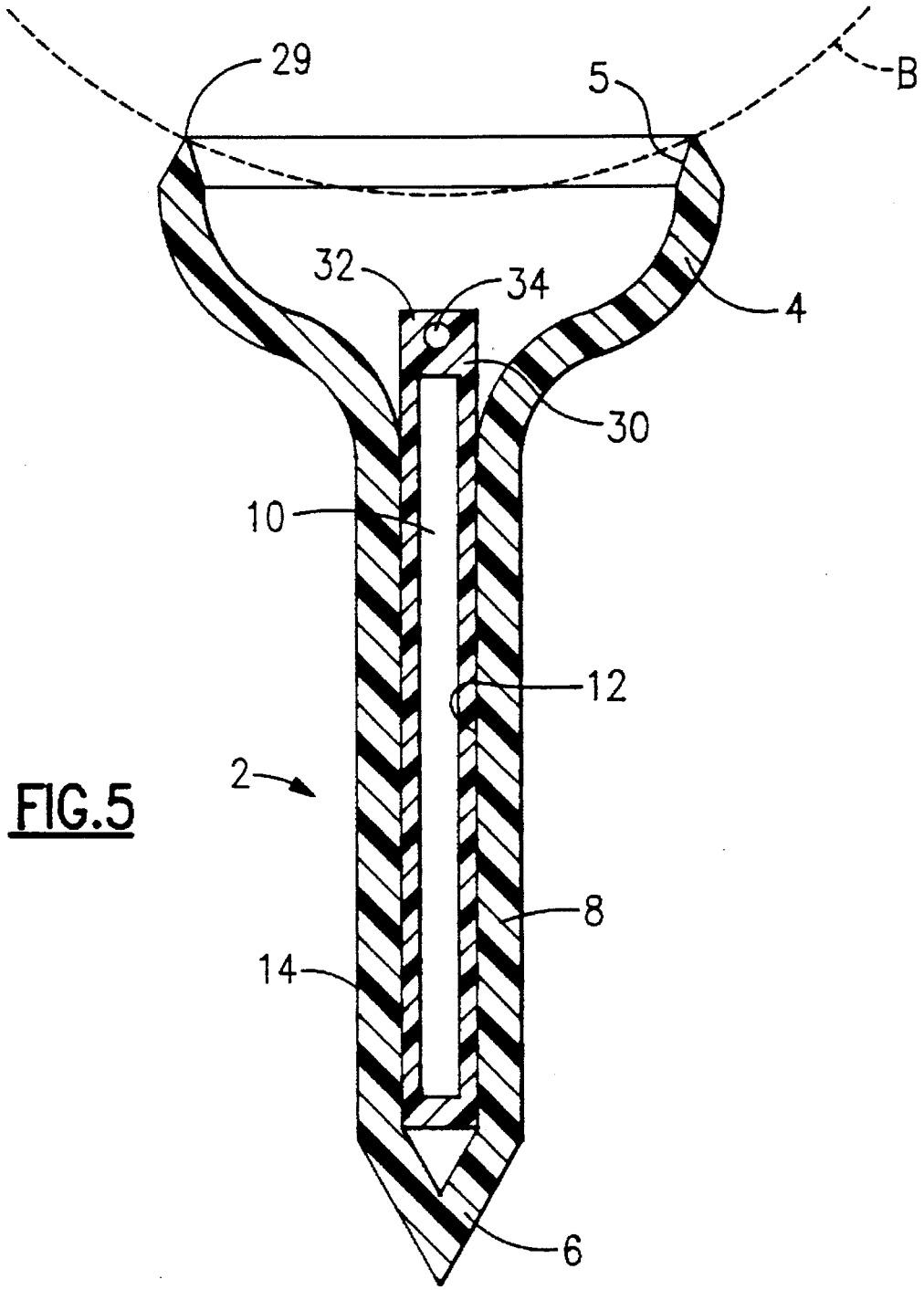
FIG. 5 is a diagrammatic front elevational cross-sectional view of a third embodiment of the synthetic golf tee, with a light stick, according to the present invention.

FIG. 5 shows a third embodiment of the present invention. This embodiment is substantially identical to the second embodiment, shown in FIG. 3, except that the ball supporting end 4 has a larger diameter than in the first two embodiments, e.g. the ball supporting end 4 has a diameter of about 14.35 mm (0.565 inches) to better facilitate insertion into the ground. In addition, the upper portion of the ball supporting end 4 tapers to a sharp circular edge 29 and has a taper which is substantially the same angle, e.g. about 10 to 60—preferably about 50 degrees, as the taper of the tapered end 6. This taper reduces the surface area on which the ball rests thereby providing the ball B with substantially a circular point contact with the synthetic golf tee 2. The circular point contact between the ball and the golf tee 2 will minimize the friction between those two components.

A light stick 30, containing an illuminated material or substance which allows a user to play golf at night, may be supported within the central bore 10 of the golf tee 2. The light stick 30 has a cylindrical shaped exterior which is of a diameter slightly larger, e.g. larger by a few millimeters or so, than the inner diameter of the central bore 10 so that when the light stick 30 is received within the central bore 10, an interference fit is achieved between those components and the light stick 30 is releasably supported by the synthetic tee 2. A handle portion 32 facilitates insertion of the light stick 30 into the central bore 10 of the golf tee 2 and a hole 34, or some other similar mechanism, facilitates removal of the light stick 30, via a wire, a hook or the like, from the central bore 10 once the round of golf is completed or the light stick 30 is exhausted. It is to be appreciated that the light stick 30 must be shorter in length than the length of the ball supporting end 4 and the intermediate portion 8 so as not to interfere with support of the ball B by the golf tee 2. As the light stick 30 forms no part of the present invention, a further description concerning the same is not provided herein.

It is to be appreciated that the overall length of the tee can be reduced to half size, i.e. having a length of about 27.31 mm (1.075 inches) while still having the same ball supporting end 4 diameter. Such a tee is very useful on par 3 golf holes or courses or when a golfer is hitting a golf ball from the tee with an iron.

It is anticipated that the synthetic golf tee 2 will be manufactured either by injection molding or some other known molding technique. If the tees are manufactured by injection molding, a powdered DELRIN® or DELRIN AF® may be employed as the synthetic material and be heated to a liquid state so that the DELRIN® or DELRIN AF® becomes molten and thereafter is allowed to set. After a sufficient solidification period, the mold is separated and the tee is removed. The synthetic material may be composite material, e.g. DELRIN® alone, DELRIN® or DELRIN AF® in combination with a phenolic resin or phenolic fiber or DELRIN® or DELRIN AF® in combination with 1–15% crushed glass or sand (sodium silicate). Further, the synthetic tee may be formed from a combination of a naturally occurring fiber or material and a synthetic material such as DELRIN AF®.

Alternatively, the tee could be machined by a (CNC computerized numerically controlled) machining device. If the tees are machined, they will preferably be machined from an elongate piece of stock. The exterior and the interior surfaces of the tee can be machined either simultaneously or sequentially, as desired. As such machining techniques are well known to those skilled in the art, a further detailed discussion concerning the same is not provided herein.

The synthetic golf tee 2 typically has a weight of about 1.0 grams to 2.0 grams (0.0022–0.0044 pounds).

It is to be appreciated that the exterior surface of the synthetic tee will not have any sharp edges or indentations which will promote fracture or cracking of the synthetic tee when struck by a golf club. Accordingly, a smoothly contoured exterior surface is desired along the entire length of the synthetic.

Since certain changes may be made in the above described synthetic golf tee, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. A hollow synthetic golf tee comprising:

a ball supporting end having an annular surface which is contoured for supporting a golf ball;

a tapered end for facilitating insertion of at least a portion of the synthetic tee into a ground surface; and an intermediate portion interconnecting said ball supporting end and said tapered end with one another to form a contiguous monolithic golf tee;

wherein a central bore extends completely through said ball supporting end, said intermediate portion and a portion of said tapered ends;

said ball supporting end tapers into a sharp circular linear edge which provides a perimeter point contact for solely Engaging with and supporting a golf ball, during use, to minimize a contact area between a golf ball and the golf tee when the golf ball is supported thereon.

2. A hollow synthetic tee according to claim 1, wherein at least said intermediate portion has a substantially uniform transverse cross sectional wall thickness along the entire length thereof.

3. A hollow synthetic tee according to claim 1, wherein both said ball supporting end and said intermediate portion have a substantially uniform transverse cross sectional wall thickness along the entire length thereof.

4. A hollow synthetic tee according to claim 3, wherein said substantially uniform transverse cross sectional wall thickness of said synthetic golf tee is between about 0.053 and 0.075 inches.

5. A hollow synthetic tee according to claim 3, wherein each of said ball supporting end, said intermediate portion and said tapered end has a substantially uniform transverse cross sectional wall thickness along the entire length thereof.

6. A hollow synthetic tee according to claim 1, wherein said central bore has a diameter of approximately 0.050 inches to 0.093 inches.

7. A hollow synthetic tee according to claim 1, wherein said golf tee is manufactured from one of a thermoplastic polymer and an acetal resin.

8. A hollow synthetic tee according to claim 1, wherein said taper of said ball supporting end has substantially the same angle as the taper of said tapered end.

9. A hollow synthetic tee according to claim 8, wherein said taper of both said ball supporting end and of said tapered end ranges between about 10 to about 60 degrees.

10. A hollow synthetic tee according to claim 1 in combination with a tee carrying device, said tee carrying device comprises an elongate cylindrical body section which has a diameter sufficiently larger than said central bore of said golf tee so that an interference fit is achieved between said cylindrical body section and said central bore whereby upon engagement between said central bore and said cylindrical body section, said synthetic tee is releasably retained by the tee carrying device.

11. The combination according to claim 10, wherein said tee carrying device includes a head section which is attached to said cylindrical body section, and said head section includes a mechanism for attaching said tee carrying device to a desired object.

12. The combination according to claim 10, wherein said tee carrying device further includes a tail section which is tapered to facilitate insertion of said tee carrying device into said central bore of said golf tee.

13. A hollow synthetic tee according to claim 1 in combination with a light stick, said light stick is accommodated within said central bore of said synthetic tee to facilitate playing of golf at night time.

14. A hollow synthetic golf tee according to claim 1, wherein said sharp circular linear edge has a circumference smaller than a maximum circumference of exterior surface of said ball supporting end and smaller than a maximum circumference of an inner surface of said ball supporting end.

15. A method of manufacturing a synthetic golf tee comprising the steps of:

providing a ball supporting end with an annular surface which is contoured for supporting a golf ball;

providing said synthetic golf tee with a tapered end for facilitating insertion of at least a portion of the synthetic tee into a ground surface;

providing an intermediate portion to interconnect said ball supporting end and said tapered end with one another to form a contiguous monolithic golf tee; and forming a central bore completely through said ball supporting end, said intermediate portion and a portion of said tapered end;

forming said annular surface of said ball supporting end with a circular linear edge which provides a perimeter point contact for solely engaging with and supporting a golf ball during use to minimize the area contact between a golf ball and the golf tee when the golf ball is supported on the golf tee;

inserting said golf tee in a ground surface; and supporting said golf ball solely by said circular linear edge to minimize the contact area between a golf ball and the golf tee.

16. A method according to claim 15, further comprising the step of providing at least said intermediate portion with a substantially uniform transverse cross sectional wall thickness along the entire length thereof.

17. A method according to claim 15, further comprising the step of providing both said ball supporting end and said intermediate portion with a substantially uniform transverse cross sectional wall thickness along the entire length thereof.

18. A method according to claim 17, further comprising the step of using a transverse cross sectional wall thickness of between about 0.053 and 0.075 inches.

19. A method according to claim 15, further comprising the step of providing each of said ball supporting end, said intermediate portion and said tapered end with a substantially uniform transverse cross sectional wall thickness along the entire length thereof.

20. A hollow synthetic golf tee in combination with a golf ball, said synthetic golf tee comprising:

a ball supporting end having an annular surface which is contoured for supporting a golf ball;

a tapered end for facilitating insertion of at least a portion of the synthetic tee into a ground surface; and an intermediate portion interconnecting said ball supporting end and said tapered end with one another to form a contiguous monolithic golf tee;

wherein a central bore extends completely through said ball supporting end, said intermediate portion and a major portion of said tapered end;

each of said ball supporting end, said intermediate portion and said tapered end has a substantially uniform transverse cross sectional wall thickness along the entire length thereof;

said ball supporting end tapers into a sharp circular linear edge which provides a perimeter point contact for solely engaging with and supporting a golf ball, during use, to minimize a contact area between a golf ball and the golf tee when the golf ball is supported thereon; and said golf ball being supported solely by said sharp circular linear edge to minimize contact between said golf ball and said golf tee.

* * * * *